US006596136B1

(12) United States Patent
Gestermann et al.

(10) Patent No.: US 6,596,136 B1
(45) Date of Patent: Jul. 22, 2003

(54) MEMBRANE ELECTROLYTIC CELL WITH ACTIVE GAS/LIQUID SEPARATION

(75) Inventors: Fritz Gestermann, Leverkusen (DE); Peter Fabian, Hanau (DE)

(73) Assignees: Uhdenora Technologies S.r.l., Milan (IT); Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/830,492

(22) PCT Filed: Oct. 20, 1999

(86) PCT No.: PCT/EP99/07949

§ 371 (c)(1),
(2), (4) Date: Apr. 27, 2001

(87) PCT Pub. No.: WO00/26442

PCT Pub. Date: May 11, 2000

(30) Foreign Application Priority Data

Oct. 30, 1998 (DE) ..... 198 50 071

(51) Int. Cl.[7] ..... C25B 9/08
(52) U.S. Cl. ..... 204/265; 204/266; 204/252
(58) Field of Search ..... 204/252, 258, 204/265, 266

(56) References Cited

U.S. PATENT DOCUMENTS 5,130,008 A * 7/1992 Cabaraux et al. ..... 204/252

FOREIGN PATENT DOCUMENTS

| | | |
|---|---|---|
| EP | 0 412 600 | 2/1991 |
| EP | 0 579 910 | 1/1994 |
| EP | 0 599 363 | 6/1994 |
| EP | 0 905 283 | 12/1998 |
| EP | 0 960 960 | 12/1999 |
| WO | 98/55670 | 12/1998 |

OTHER PUBLICATIONS

**Database WPI, Section Ch, Week 298405, Derwent Publications Ltd., London GB. AN 1984–026964, XP002130073 & JP 58 217684 A (Tokuyama Soda KK), Dec. 17, 1983.

* cited by examiner

*Primary Examiner*—Bruce F. Bell
(74) *Attorney, Agent, or Firm*—Joseph C. Gil; Diderico van Eyl

(57) ABSTRACT

The invention relates to an electrochemical half cell (1) which consists of at least one membrane (4), an electrode (3) as anode or cathode which optionally produces gas, optionally an outlet (8; 16) for the gas and a support structure (12) linking the electrode which optionally produces gas with the back wall (15) of the half cell. The support structure (12) divides the interior (13) of the half cell (1) into vertically arranged channels (5, 9). The electrolyte (14) flows upwards in the electrode channels (9) facing the electrode (3) and flows downwards in the channels (5) facing away from the electrode (3). The electrode channels (9) and the channels (5) facing away from the electrode (3) are interlinked at their upper and lower ends.

13 Claims, 3 Drawing Sheets

Section B – B'

Section A – A'

MEMBRANE ELECTROLYTIC CELL WITH ACTIVE GAS/LIQUID SEPARATION

The invention relates to an electrochemical half-cell which at least comprises a membrane, an electrode, which may generate gas, as anode or cathode, optionally an outlet for the gas, and a supporting structure which joins the electrode, which may generate gas, to the half-cell rear wall. The supporting structure divides the interior of the half-cell into vertically arranged channels, the electrolyte flowing upwards in the electrode channels facing the electrode and flowing downwards in the channels facing away from the electrode, and the electrode channels and the channels facing away from the electrode being connected to one another at their top ends and at their bottom ends.

Incomplete or incorrectly performed gas separation in the upper region of prior art electrolytic cells will lead to inadequate wetting of the membrane at this location and an increase in the electrical resistance of the membrane. This results in an increase in the integral cell voltage and additionally carries the risk of local membrane damage due to so-called "blistering". The damage to the membrane can be so significant as to allow electrode gas to pass through and, possibly, explosive gas mixtures to form. Moreover, erroneous gas separation may give rise to pressure surge pulses in the electrolyte compartment, resulting in membrane movements wvith a risk of premature ageing due to mechanical damage.

A further problem is that of operating the electrolytic cell employing as homogeneous a vertical and horizontal temperature and concentration distribution (salt concentration or pH of the electrolyte) as possible in the region of the electrolyte compartment upstream of the membrane surface, likewise in order to avoid premature membrane ageing. This is generally desirable for the operation of all gas-generating electrolysers, but especially for the use of gas diffusion electrodes in which the heat dissipation (removal of lost heat) must take place predominantly or entirely via the electrolyte circulation on the other, gas-generating side, depending on whether a finite electrolyte gap (finite gap) or a resting gas diffusion electrode is employed beyond the membrane. This may involve a reduction in the temperature of the incoming fresh electrolyte for the gas-generating side, which must not lead to local overcooling here.

In the past there have been a few proposals for mitigating these problems, albeit only for the classic hydrogen-generating NaCl electrolysis. For example, the European Offenlegungsschrift (European Published Specification) EP 0579910 A1 discloses a system to induce an internal natural circulation, especially in order to render acidification of brine for the NaCl electrolysis more effective and to reduce excessive foaming in the upper region of the electrolytic cell.

The European Offenlegungsschrift (European Published Specification) EP 0599363 A1 discusses various methods of dealing with gas bubbles caused by the process, without mentioning the decisive elements which enable complete separation of gas and electrolyte at the same time as entirely pulsation-free and even joint outflow of the separated phases from the cell and which enable equalization of temperature and concentration right into the corners of the cell.

The solution of these problems of the known electrolytic half-cell arrangements is achieved by a half-cell according, to the precharacterizing clause with the characterizing features of the independent claim.

The present invention relates to an electrochemical half-cell at least comprising a membrane, an electrode, which may generate gas, as anode or cathode, and a supporting structure which joins the electrode, which may generate gas, to the half-cell rear wall as well as an inlet for the electrolyte and an outlet for the electrolyte and optionally for the gas, characterized in that the supporting structure divides the interior of the half-cell into vertically arranged channels, the electrolyte flowing upwards in the electrode channels facing the electrode and flowing downwards in the channels facing away from the electrode, and in that the electrode channels and the channels facing away from the electrode are connected to one another at their top ends and at their bottom ends.

In particular, the channels carrying a downward flow and the electrode channels are arranged alternately next to one another or else behind one another.

In this arrangement, the channels carrying a downward flow and the electrode channels can have a trapezoidal cross section.

Preferably, the channels carrying a downward flow and the electrode channels are formed by a folded metal sheet, an electrically conductive one, as a supporting structure.

In a particularly advantageous embodiment of the half-cell, the electrode channels have a cross-sectional constriction at their top ends.

A vertically aligned, parallel supporting structure in a specific arrangement separates the channels which are open towards the electrode and in which the lighter electrolyte-gas mixture is rising, from channels which are open towards the rear wall and in which the degassed, heavier electrolyte flows downwards again. An essential feature to improve the gas separation is a constriction located herein at the top of the electrolyte channels, which is produced by an aerofoil wing-like flow deflector profile which is curved towards the electrode. The two-phase flow is accelerated in the constriction between electrode and profile, is expanded above the rearward curved top edge of the profile and is degassed on the rear of the profile while phase separation takes place. On its rear, the profile exposes orifices into the downcomer channels, so that the heavier electrolyte, heavier because it has been degassed, flows downwards and at the half-cell bottom, via communication orifices, flows as the gas-absorbing fraction, together with electrolyte freshly fed in, into the channels which are open towards the electrode, and thus effects the internal natural circulation of the electrolyte.

Preferably, the cross-sectional area of the electrode channels in the narrowest region of the constriction in proportion to the cross-sectional area of the electrode channels below the constriction is from 1 to 2.5 to 1 to 4.5.

The constriction of the electrode channels can be formed, for example, by an angled guide structure.

In particular, the constriction of the electrode channels has a region of constant cross section, the height of this region being at most 1:100 in proportion to the height of the active membrane surface.

Fabrication of the half-cell is possible in a particularly simple manner if the guide structure and the supporting structure form one piece.

Equally advantageous is a design of the half-cell in which the supporting structure is in the form of one piece over the entire height of the electrode channels and the channels carrying a downward flow.

Advantageous for gas separation from the electrolyte is a design in which the electrode channels above the constriction have an expansion of their cross sections.

The excess electrolyte leaving the cell can be discharged, downstream of the flow deflector profile, either laterally at the top or downwards via a vertical pipe.

Particularly advantageous, therefore, is a half-cell which has an outlet for the degassed electrolyte and any gas formed during the electrolysis, in particular a vertical pipe with a through-hole in the cell bottom, or an outlet disposed on a side wall of the cell, said outlet being disposed just above the top ends of the electrode channels.

As experimental experience shows, it is most especially advantageous for the overall structure—apart from the communication orifices right at the bottom and the communicating gap having a width of a few mm above the profile right at the top—to consist of a functional unit in order to fulfil the following functions:

Separation of the gas bubbles from the electrolyte via the so-called "bubble jet" at the top in order to enable discharge of electrolyte and product gas separately or alternatively jointly as separated phases, but above all without any pressure pulses Equalization of the vertical temperature profile by means of a vigorous natural circulation over the full height in order to optimize the membrane function Equalization of the vertical concentration profile via the same mechanism in order to optimize the membrane function Equalization of the vertical pH profile, e.g. in the case of systematic acidification of the brine in NaCl electrolysis in order to improve the chlorine yield and quality. Local over-acidification of the brine would be damaging to the membrane In addition to the hydraulic function, the supporting structure assumes the function of mechanically retaining the electrode and in addition the function of low-resistance connection of the electrode to the cell rear wall.

In a preferred variation, the supporting structure together with the electrode channels and the downflow channels fills the interior of the half-cell to at least 90%.

Preferably, the supporting structure is electrically conductive and is connected electroconductively to the electrode and to in particular to the rear wall of the half-cell.

The electrode is then preferably connected electroconductively to the supporting structure of the half-cell and is mounted on the supporting structure.

For the purpose of regulating the temperature of the electrolyte, upstream of the inlet of the electrolyte there is preferably a heat exchanger via which fresh electrolyte and optionally degassed electrolyte recirculated from the outlet are introduced into the half-cell, thus forming a temperature-controlling electrolyte circulation if required. The pressure-surge-free and complete separation of the gas bubbles, in conjunction with the equalization of temperature profile, concentration profile and pH profile gains particular significance when gas diffusion electrodes are used in one of the half-cells, be it on the anode or cathode side, in the case of a gas-generating process on the other side of the membrane. In these cases, dissipation of the ohmic lost heat must take place largely or entirely via the electrolyte from the gas-generating side of the electrolyser, depending on the type of operation of the gas diffusion electrode.

The electrolyte processed in the anode compartment is e.g. an aqueous sodium chloride solution or a hydrochloric acid solution, the anode gas produced in the process being chlorine. The counterelectrode is an oxygen-consuming cathode.

If, e.g. with NaCl electrolysis, an oxygen-consuming cathode having a narrow catholyte gap is operated on the cathode side, as described in EP 0717130 B1 and follow-up patents, cathode-side heat dissipation can take place only via plug flow without turbulence, shifting the heat balance more towards the anode side, if one wishes to avoid employing excessive cathode-side heating intervals, which are known not to benefit the membrane. Here it is therefore necessary either to operate with a cooled electrolyte in a single-feed arrangement or alternatively, if appropriate, with a likewise cooled anolyte circulation, in order to keep temperature distributions inside a cell at the optimal level.

If e.g. an NaCl or alternatively HCl electrolysis is performed with resting oxygen-consuming cathode, cathode-side heat dissipation is marginal; the heat must be dissipated virtually entirely via the anolyte. This generally requires an external anolyte circulation with cooling.

In all these cases, particular significance is attached to internal equalization of temperature, concentration and possibly pH, since the amount of electrolyte fed into the cell increases relative to the internal circulation, so that the latter must be particularly intensive in order to avoid anything being askew, even just locally. This particularly applies to a, quite desirable, hefty acidification of the brine in the case of NaCl electrolysis, said acidification generally having to be carried out in line with the lowest local pH.

If the half-cell having a finite catholyte gap is operated upstream of an oxygen-consuming cathode, some of the lost heat can be dissipated on the cathode side via the flow through said catholyte gap and external cooling, while the predominant fraction of the lost heat is dissipated with the anolyte stream.

If, on the other hand, the half-cell is operated with an oxygen-consuming cathode resting on the membrane (zero gap), the entire lost heat is dissipated via the anolyte stream.

Further advantages of the half-cell according to the invention are therefore the vertical equalization of the temperature of the electrolyte and the vertical equalization of the electrolyte concentration.

The half-cell according to the invention can be used generally in all gas-generating electrolyses. It gains particularly significance in electrolyses in which electrolyte and gas can be separated from one another only with some difficulty.

The invention is explained below in more detail, by way of example, with reference to the figures without the invention thereby being limited in any specific point.

EXAMPLES

Figure 1:
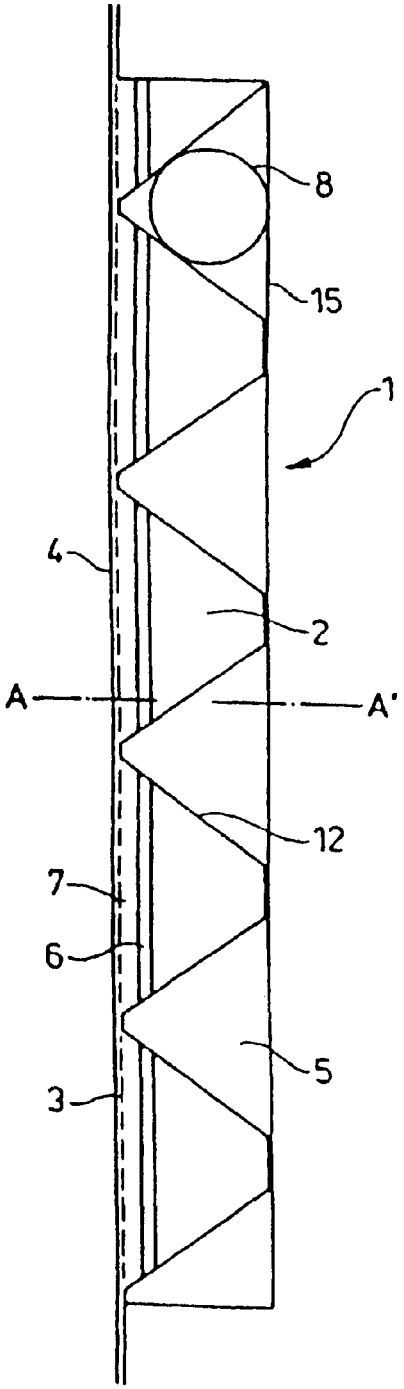
FIG. 1 shows a schematic cross section through a half-cell according to the invention without current lead on B–B' in FIG. 3

Welded electroconductively into a half-cell 1 is a flow structure and day structure 12 (FIG. 1). It supports the electrode structure 3 on top of which, in turn, the membrane 4 either rests or is positioned at a relatively small distance from the electrode structure 3.

The supporting structure 12 is composed of trapezoidal metal sheets which form vertical channels which alternately are open towards the electrode or, as downflow channels 5, point towards the rear wall 15.

The fresh electrolyte 17 flows, via an inlet pipe 10 and through orifices 11, into the half-cell interior 13, the orifices 11 being distributed in such a way that they supply each of the channels 9 open towards the electrode with fresh electrolyte. Depending on applications, the orifices 11 may also be disposed below the downflow channels 5, in order to improve mixing between the fresh electrolyte and the electrolyte flowing downwards in the downflow channels 5 (see FIG. 2).

The gas generation at the electrode 3 leads to buoyancy of the electrolyte in the channels 9 open towards the electrode. The electrolyte 14 with gas bubbles interspersed therein, flows upwards here, is deflected towards the electrode at a profile structure 2 which emerges from the trapezoidal metal sheet. Said electrolyte is accelerated in the gap 7 between electrode 3 and profile structure 2 and is expanded in the channel 9 cross section widening again above the profile structure. The alternation between acceleration and expansion ensures highly effective bubble separation, so that virtually complete separation between electrolyte and electrode gas is effected right on the rear of the profile structure. The profile structure 2 projects only into the upflow channels 9, but is open towards the downflow channels 5. Thus the degassed, heavier electrolyte can flow downwards in the downflow channels 5, mix with the fresh electrolyte flowing in at the bottom, and as a result of the gas generation at the electrode structure revert to an upward flow, thereby giving rise to intensive natural convection (see FIG. 3).

Figure 2:
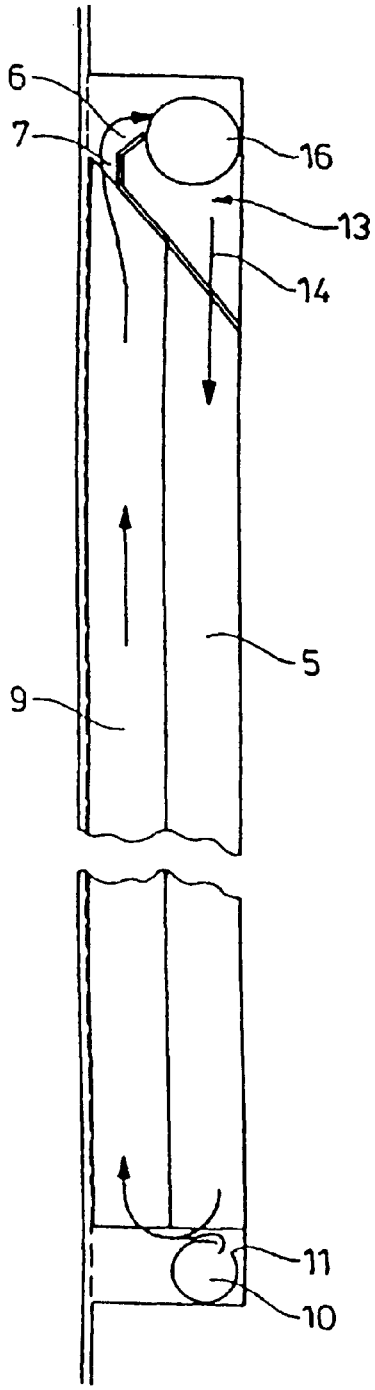
FIG. 2 shows a schematic longitudinal section through a half-cell according to the invention on A–A' in FIG. 3
Figure 3:
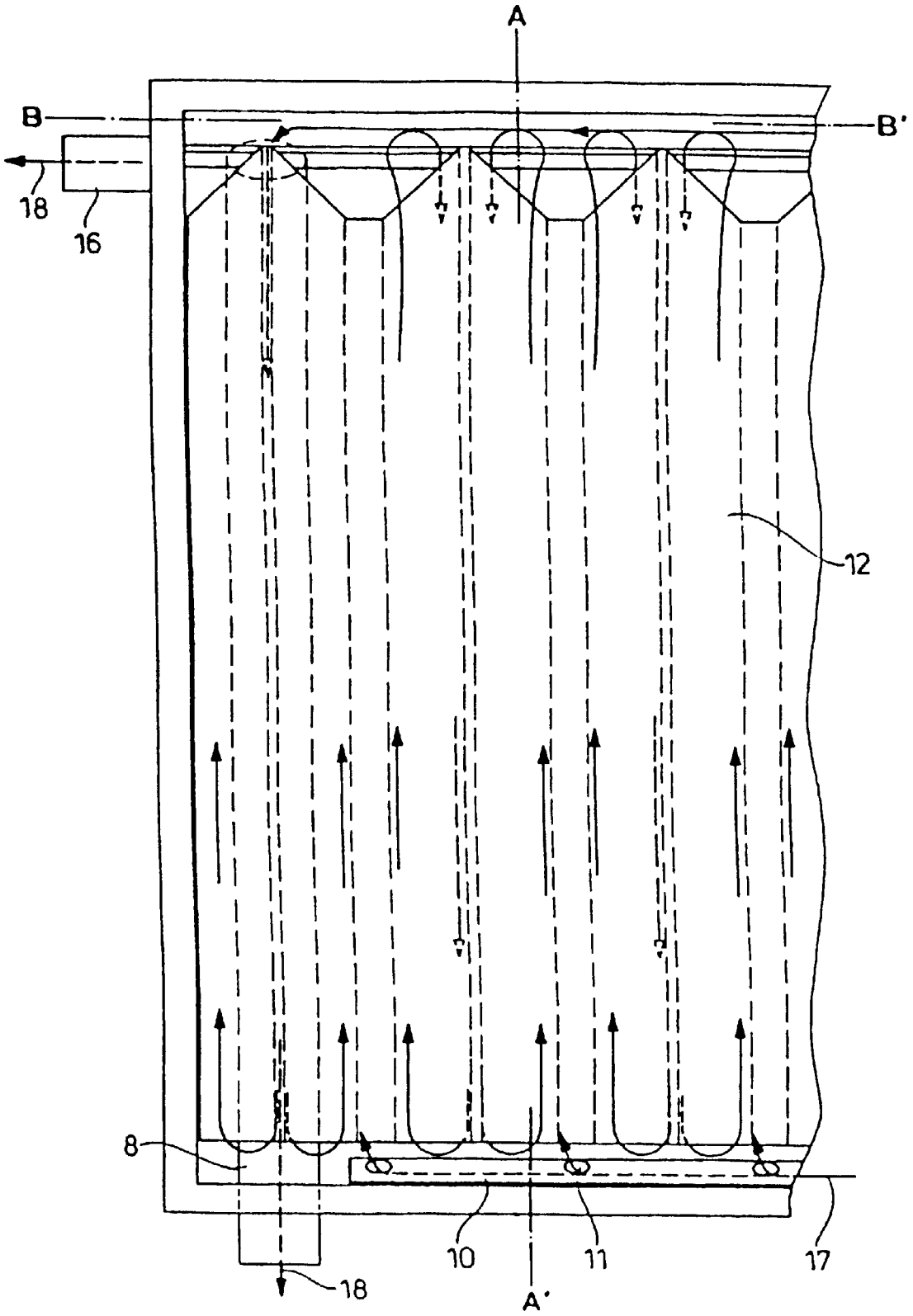
FIG. 3 shows the front view of the half-cell according to the invention with the electrode removed

The excess electrolyte 18 leaves the half-cell 1, together with the gas separated off behind the profile 2, either via a vertical pipe 8, as shown in FIGS. 1 and 3, or alternatively via a lateral outlet 16, as drawn by way of alternative in FIG. 2 and in FIG. 3.

Figure 4:
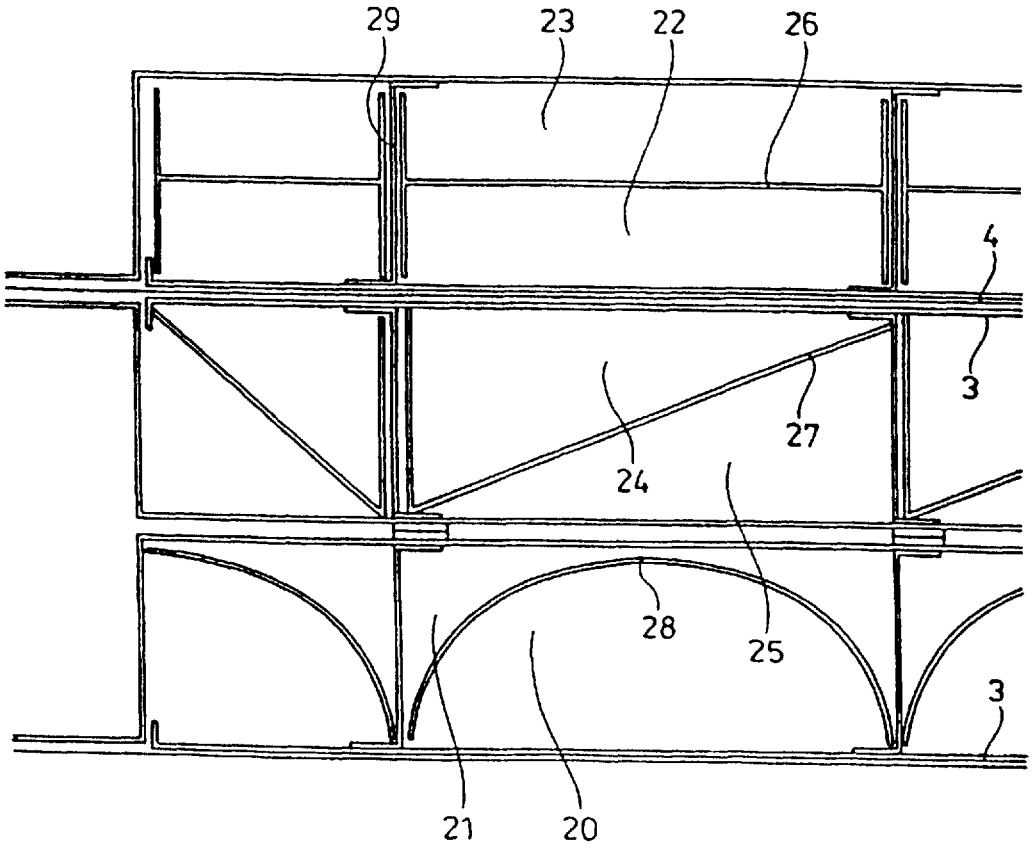
FIG. 4 shows alternative structures with respect to the flow path in the half-cell according to the invention

As an alternative to the flow structure fashioned from trapezoidal metal sheets, the following variations can also be employed with comparable success (compare FIG. 4). In the case where the gas-generating electrodes 3, be they anodes or cathodes, are connected to the rear wall of the half-shells 1 via vertically inserted structural elements 29, there is the option of inserting, between these structural elements, flow guide structures of half-round shape 28 comprising the bubble upflow region 20 and the downflow region 21, as a diagonal element 27 comprising the bubble upflow region 24 and the downflow region 25, or as a separator element 26 comprising the bubble upflow region 22 and the downflow region 23 and running parallel to the rear wall. The separator element 26, in particular, can alternatively, as a continuous plate, penetrate the structural elements 29 in a suitable manner and extend over the entire element width. Alternatively, it may prove advantageous for these separator elements each to be inserted individually between the structural elements 29, before the electrodes 3 are welded in and fix the separator elements in position.

An essential point is that the respective flow channels, in analogy to the trapezoidal structures, extend over the entire height of the element and, in the upper region, constrict the bubble upflow regions—not shown here—in analogy to the profile structure 2, to trigger degassing of the electrolyte after the constriction has been passed. As the separator elements 26, 27, 28 do not have any electrical function they can be made not only of metal but also fabricated, to be non-conductive, from suitable plastic mouldings of appropriate chemical stability and thermal stability. Suitable, depending on application, are e.g. EPDF; halar or telene.

Example 1

Implemented in an NaCl electrolysis pilot cell containing 4 bipolar elements having an area of 1224×254 $mm^2$ each, the height corresponding to the full industrial-scale height, with a depth of the anode half-cell 1 of 31 mm, are two fill and two half riser channels 9 and three downcomer channels 5, using a folded metal sheet 12 as a supporting structure which divides the half-cell interior 13 (FIG. 1 shows an arrangement comprising one half and four full riser channels 9 and one half and four full downcomer channels 5). The current contact to the anode 3 was effected from the half-cell rear wall 15 via the supporting structure 12. The profile structure 2 covers the riser channels 9 at the top end at an angle of about 60° and constricts the flow cross section down to a 6 mm wide gap 7 towards the anode 3. The recurved section 6 of the profile 2 leaves an 8 mm gap to the top edge of the half-cell 1 for the rearward passage of the two-phase flow (see FIG. 2). The passages towards the downcomer channels 5 are open for unimpeded downflow of the degassed electrolyte 14. At the bottom end there remains a gap having a width of about 20 mm, through which the downflowing, degassed brine 14, together with the fresh brine 16 fed in from the orifices 11 of the line 10, can flow once more into the riser channels 9, where it is again enriched with anode gas. The excess anolyte brine is taken up via a vertical pipe 8 which ends slightly below the top edge of the profile 2 and is discharged downwards from the cell 1. In the cathode half-shell (not shown), oxygen-consuming cathodes in finite gap mode are used, with a catholyte gap of 3 mm.

A continuous test was carried out to study to what extent phase separation takes place and whether cell can be operated free from pressure pulses. It was found that the half-cells can be run in an operating range of between 3 and 7 $kA/m^2$ with complete separation of gas and electrolyte, i.e. the outflowing anolyte was completely bubble-free and flowed out wholly uniformly and without any sensible or visible pulsation.

Example 2

A mode of operation was tested in which, with a suitably tailored catholyte circulation, the heat balance was adjusted in such a way via precooled brine, that the outlet temperature was limited to 85° C. As a function of the current density set, the following temperature rises were observed:

| Current density ($kA/m^2$) | Brine (° C.) | Alkali (° C.) | Pumpover rate alkali (l/h) | Pumpover rate brine (l/h) |
|---|---|---|---|---|
| 3 | 77–85 | 77–85 | 250 | — |
| 4.5 | 68–85 | 75–85 | 250 | — |
| 6 | 44–85 | 77–86 | 400 | 50 |

It was found that, given the very high current densities, a moderate anolyte circulation with suitable precooling is advisable, in addition, to effect heat dissipation. Only thus, and with commercially realistic brine inlet temperatures is it possible to push the catholyte-side temperature rise to <10 K.

What is claimed is:

1. An electrochemical half-cell comprising:

(a) a membrane;

(b) an electrode for generating gas as an anode or a cathode;

(c) a supporting structure for joining the electrode, wherein the supporting structure divides the interior of the half-cell into (i) a first set of vertically arranged channels, which face the electrode, for flowing an electrolyte upwards, and (ii) a second set of vertically arranged channels, which face away from the electrode, for flowing the electrolyte downward, wherein the first set of vertically arranged channels and the second set of vertically arranged channels have top ends and bottom ends, the first set of vertically arranged channels have a cross-sectional constriction formed by a guide structure, at the top ends of the first set of vertically arranged channels, and the first vertically arranged channels and the second vertically arranged channels are connected to one another at their top ends and their bottom ends, wherein the supporting structure is attached to a guide structure and the supporting structure and the guide structure form one piece, and wherein the cell has an interior, a gas inlet, and a gas outlet.

2. The half-cell according to claim 1, wherein the second set of vertically arranged channels and the first set of vertically arranged channels are arranged alternately next to one another.

3. The half-cell according to claim 1, wherein the second set of vertically arranged channels and the first set of vertically arranged channels have a trapezoidal cross section.

4. The half-cell according to claim 1, wherein the second set of vertically arranged channels and the first set of vertically arranged channels are formed by a folded metal sheet.

5. The half-cell according to claim 1, wherein the first set of vertically arranged channels have a cross-sectional area in proportion to the cross-sectional area of the channels below the constriction ranging from 1 to 2.5 to 1 to 4.5.

6. The half-cell according to claim 1, wherein the constriction of the first set of channels has a region of constant cross section and in that the height of this region is at most 1:100 in proportion to the height of the active membrane surface.

7. The half-cell according to claim 1, wherein the first set of channels above the constriction have an expansion of their cross sections.

8. The half-cell according to claim 1, wherein the supporting structure is in the form of one piece over the entire height of the first set of electrode channels.

9. The half-cell according to claim 1, wherein the outlet is a vertical pipe or an outlet disposed on a side wall of the cell, wherein the outlet is disposed just above the top ends of the second set of channels.

10. The half-cell according to claim 1, wherein the supporting structure and the first set of channels and the second set of channels fill the interior of the half-cell to at least 90%.

11. The half-cell according to claim 1, wherein the supporting structure is electrically conductive and is connected electroconductively to the electrode and a rear wall of the half-cell.

12. The half-cell according to claim 1, wherein the electrode is connected electroconductively to the supporting structure of the half-cell and is mounted on the supporting structure.

13. The half-cell according to claim 1, wherein the electrolyte is an aqueous sodium chloride solution or a hydrochloric acid solution and the electrode is a chlorine-generating anode, while a corresponding cathode is operable as an oxygen-consuming cathode.

* * * * *